United States Patent [19]

Asghar et al.

[11] Patent Number: 4,735,664

[45] Date of Patent: Apr. 5, 1988

[54] INTEGRATED DECORATION OF ARTICLES

[75] Inventors: Syed A. Asghar, Brockton; Fritz Bauer, Shrewsbury; Joseph F. Callinan, Natick; Voldemars Kaliksons, Harvard; Jack Zettler, Stow, all of Mass.; Peter Imondi, Providence, R.I.; Alan Wysoki, Millis; Tim Somadelis, Auburn, both of Mass.

[73] Assignee: Dennison Manufacturing Company, Framingham, Mass.

[21] Appl. No.: 763,101

[22] Filed: Aug. 6, 1985

[51] Int. Cl.[4] ..... B32B 31/00

[52] U.S. Cl. ..... 156/64; 156/361; 156/542

[58] Field of Search ..... 156/540–542, 156/361–364, 344, 584, 238, 241, 64

[56] References Cited

U.S. PATENT DOCUMENTS

| | | | |
|---|---|---|---|
| 3,729,362 | 4/1973 | French et al. | 156/363 X |
| 3,928,115 | 12/1975 | Kerwin | 156/363 |
| 4,256,996 | 3/1981 | Brooks et al. | 242/75.51 X |
| 4,280,081 | 7/1981 | Dinger et al. | 242/75.51 X |
| 4,436,251 | 3/1984 | Deyesso et al. | 242/75.51 X |

*Primary Examiner*—David Simmons

*Attorney, Agent, or Firm*—George E. Kersey

[57] ABSTRACT

A decorator controlled by a signal processor for applying heat transfer labels and the like to articles. Servo circuits accept processor commands and direct operation of label feed and transfer elements. A transfer roller moves in a continuously variable manner to follow the contour of the article surface. A position roller precisely matches web movement to article movement, or enables controlled stretching or shrinking of the labels as they are applied to articles. A turret loads, indexes, and unloads articles for label application at two decorating sites. Indexing of the articles takes place as the turret is rotated.

16 Claims, 12 Drawing Sheets

42I
44I
48I
64D
60I
62I
C
B
A
48I
C1
B1
A1
A2
A3
32I
22I
26I
36I
28I
34I
B2
30I
A4
20I
25I
10I

400B
A
20D
43R
14R(66R)
(x2)
26R
60R;22R
56R
58R
28R
44R
G
H
42T
402T
C
401C
D
411R
E
F
S
409C
407R
407T
406S
EA
EC
ER
EM
ET
ES
408C
406R
406T
404S
430C
402R
400R
400M
404T
400T
402S
400S
TURRET
400A
POSITION
SUPPLY / TAKE-UP
METERING
TRANSFER
STORAGE
WEB TENSION
PROCESSOR
PLL
B
410C
KEY:
ENCODER:
SERVO:
MOTOR:
AMP:

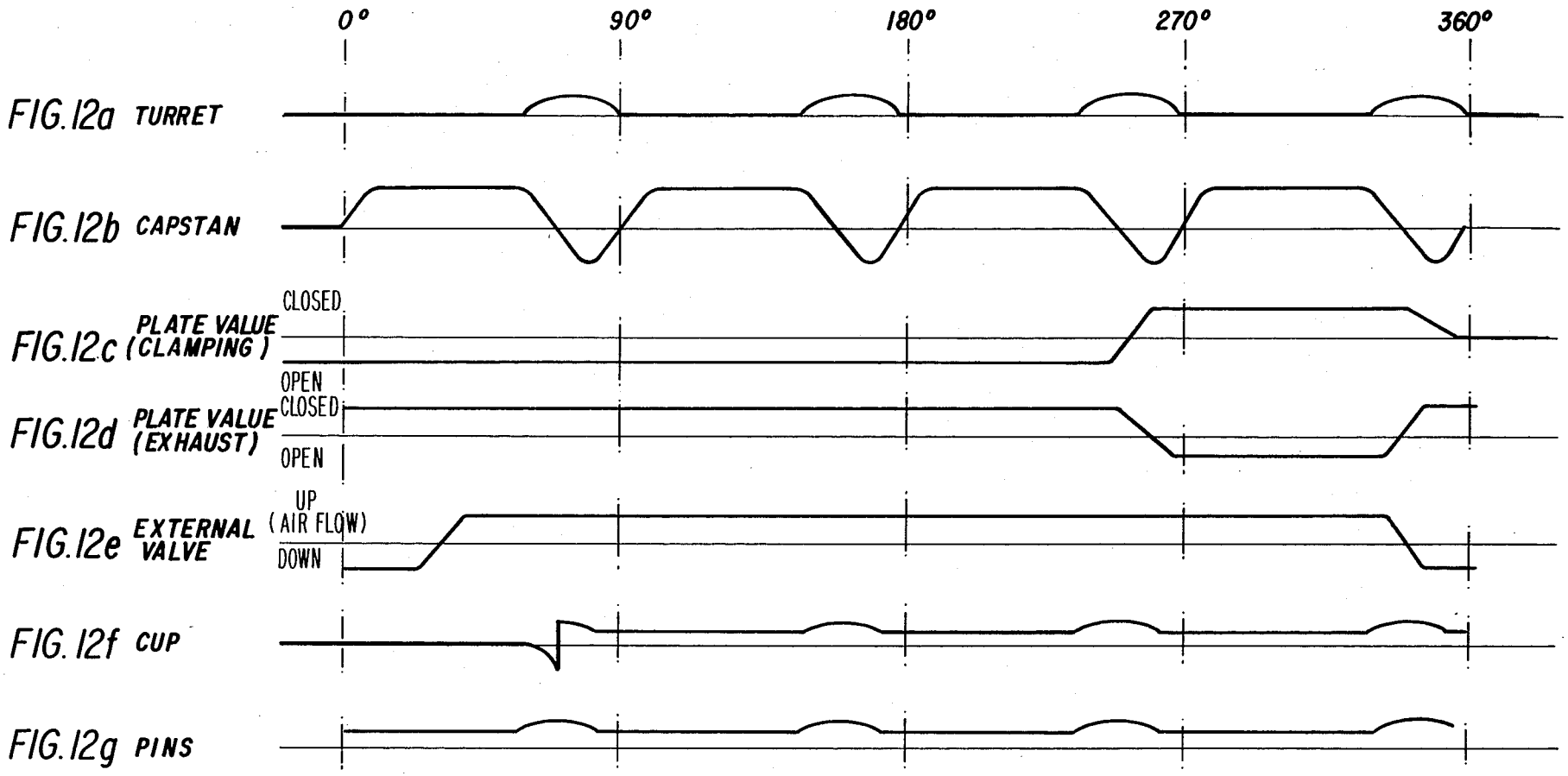
FIG. 12a TURRET
FIG. 12b CAPSTAN
FIG. 12c PLATE VALUE (CLAMPING)
FIG. 12d PLATE VALUE (EXHAUST)
FIG. 12e EXTERNAL VALVE
FIG. 12f CUP
FIG. 12g PINS

INTEGRATED DECORATION OF ARTICLES

BACKGROUND OF THE INVENTION

The invention relates to the decoration of articles, and more particularly to decorations by labels transferred from a web.

In web transfer decorating, it is desired to coordinate movement of web bearing labels with the movement of the article to which the label is to be applied. Coordination poses significant problems, for the linear velocity of the web must match the linear velocity of the article surface, otherwise label distortion results. One approach, taken in U.S. Pat. No. 4,300,974 to Bauer, is to drive the web at a fixed velocity, while moving the article at a varied velocity, thus maintaining matched linear velocities at the contact area for complex article shapes. A cam having a shape resembling the article is coupled to an article support via a cable. In U.S. Pat. No. 3,540,968, a base has a similar shape to the article, and is driven by a chain and pinion. In the decoration of oval articles, matching velocities are attained by providing a turret having a radius equal to the radius of the article side to be decorated. U.S. Pat. Nos. 3,861,986 to Wochner; 3,823,218 to Geurtsen.

Web registration is another consideration in transfer labelng. It is desired to position the label at a particular place on the article, and to maintain placement over many successive transfers. U.S. Pat. Nos. 4,452,659 to Guertsen, and 4,381,211 to Nechay are illustrative of one method, whereby the web is driven by a roller in response to signals from an optical sensor. Accordingly, an additional consideration is the alignment, or indexing of round articles, to present a predetermined portion of the article circumference to the web at the start of transfer. In the prior art, a separate station is maintained, whereby the article is rotated by pins cooperative with recesses in the article underside. After indexing, the article is pushed to the decorating station.

Accordingly, it is an object of the invention to provide for matching the velocity of the web with the article periphery, without the need for adjusting the rotational velocity of the article during decoration.

It is a further object of the invention to provide for registration of the web with respect to the article, while independently varying the web velocity.

Another object of the invention is to avoid delays attendant with a separate article indexing station, by indexing the article as it is conveyed to a decorating site.

An additional object of the invention is to enable modification of relative web and article movements before, after, and during decoration, without replacement or modification of mechanical elements.

A further object is to avoid the requirement of matched turret and article radii in the decoration of ovals and other articles.

It is an additional object of the invention to provide a transfer decorator which is faster, more reliable, and simpler to operate than apparatus of the prior art.

SUMMARY OF THE INVENTION

In accomplishing the foregoing and related objects, the invention provides for the application of heat transfer and other labels, by sensing the movement of the articles to be decorated and feeding the web relative to the movement of each article. Two web modules cooperates with a single turret, for greater efficiency and speed. A processor coordinates movement of web and turret module elements, thus enabling rapid automatic adjustments, and high quality decorations.

In accordance with one aspect of the invention, a turret moves articles to a label application, or decorating site. Movement of the articles is closely monitored by sensors. A processor receives signals from the sensors, and commands web feeding elements to move in relation to the article. As a result, stretching or shrinking of the label as it is applied to the article may be virtually eliminated, if desired. Alternatively, controlled stretching and shrinking are faithfully executed.

In accordance with another aspect of the invention, two servo controlled metering rollers define a decorating loop. The metering rollers feed one label length of web for each decoration. Within the decorating loop are two dancer rollers, which exert a tensioning force on the web, provided by two air cylinders. The processor commands the amount of pressure applied to the cylinders. A servo controlled position roller is disposed in line between the dancer arms, and operates to bidirectionally move the web at precise speeds. The processor directs the movement of the metering and position rollers via their respective servos.

In accordance with a further aspect of the invention, one metering roller is coupled to a servo controlled motor. The second metering roller is coupled to the motor via a differential. An adjusting motor is connected to the differential drive input, wherein the second metering roller may be driven at a different speed than the first metering roller. By driving the differential, the amount of web within the decorating loop, or web storage, may be adjusted.

In one aspect of the invention, web storage is accomplished by holding one metering roller (a first nip) at rest while allowing the position roller to move freely. The second metering roller (second nip) is rotated by a differential adjustment motor. When the length of web in the decorating loop has attained the directed value, the position roller is rotated to position one of the dancer rollers in an optimum position for beginning the decoration cycle.

In accordance with another aspect of the invention, a servo circuit is provided, operative to ensure faithful execution of processor commands. A Random logic unit (RLU) receives input from the processor and sensors. An up/down counter circuit is connected to the RLU. Signals from the counter pass through a digital to analog (D/A) converter, and are then amplified for driving a motor. Differences in commanded pulses and pulses from the sensors are stored in the counter, whereby command signals are retained if they cannot immediately be executed. As a result, the element is positioned exactly as commanded, and remains true over an unlimited time period.

In another apsect of the invention, a phase locked loop (PLL) circuit receives signals from sensors monitoring article movement, and from the processor, based upon rotational position and radius of the article, and the radius of the positioning roller. The output is amplified and used to drive the position roller.

In accordance with a further aspect of the invention, a transfer roller is positioned at the decorating site, operative to apply labels to the articles. An elongated carriage couples the transfer roller to a motor, whereby the roller is moved to follow the article contour as same is fed. In one embodiment, a non-round articles is rotated in a continuous manner past the decorating site, wherein transfer roller movement enables decoration of irregular surfaces. The motor output shaft is disposed perpendicularly and in close proximity to the carriage. At least two flexible bands are each fastened at one end to the carriage, and at the other end to the motor shaft, wrapping around a portion of the latter. At least one band is wrapped clockwise around the shaft, and at least one band is wrapped counterclockwise around the shaft, thereby permitting controlled bi-directional movement. The processor either senses or is informed of the article contour at the transfer roller, and commands movement of the motor via a servo to effectuate desired transfer roller movement.

In accordance with another aspect of the invention, a turret module is provided for feeding articles. Two articles may be loaded, indexed, decorated, and discharged using two web modules and one turret. A base contains a motor coupled to a rotary cam drive, for providing continuous and intermittent motion outputs. A shaft extends upwardly from the base, and is connected to the intermittent output. A sleeve is disposed about the shaft, and is connected to the continuous output. Indexing cups are radially disposed about the intermittent output shaft. Each cup contains one or more indexing pins connected in non-axial parallel alignment with a shaft. The shaft is connected via a pulley and belt to the continuous motion sleeve, thereby imparting continuous rotational motion to the indexing pins. The cup has a supporting rim which is rotatably mounted in axial alignment about the shaft. A clamping nozzle urges the article into mating contact with the rim. As the turret, or drive shaft is rotated away from the loading site, the cup is contacted by a friction member. Thus, a reverse motion is imparted to the cup, relative to the rotational motion of the cup shaft. As a result, with two indexing pins, indexing occurs in less than a 180° rotation of the indexing pins, without delay of the article at the loading station.

In accordance with a further aspect of the invention, the clamping nozzle additionally provides for inflation of flexible articles. An air cylinder contains a ported shaft rotatably supporting the nozzle at its extremity. One source of pressurized gas is connected to the air cylinder to drive the shaft, and another source of pressurized gas is connected to the ported shaft, such that when the shaft is driven downwardly, pressurized gas enters the port. A rotary plate valve is connected to the intermittent motion drive shaft, communicative with the two sources of pressurized gas, operative to permit gas passage at appropriate timed intervals. To operate the air cylinder when the turret is at rest, an external processor controlled valve is provided, as for lowering the ported shaft at the loading station.

Accordingly, the invention provides for coordination of web, article, and transfer roller movement. Adjustments are made by the apparatus with greater accuracy and speed than is possible by a human operator. Web tension and storage are continuously adjusted, thus avoiding web breakage and poor decorations, while reducing downtime.

Additionally, the apparatus of the invention is capable of decorating at a much greater speed per web than the prior art. The servo controlled motors are capable of responding faster, and with greater subtlety, than existing mechanical systems. Complex article shapes are easily accommodated by the continuously adjustable transfer roller and web.

The transfer roller assembly of the invention is resistant to wear, due to the band and carriage mechanism. This mechanism provides for rapid and faithful execution of processor commands, due to its low inertia and close tolerance configuration.

Phase locked loop and servo circuits provide for absolute execution of processor commands. Particularly, the position roller rotates in a complex pattern, which must not vary from that commanded. By precisely controlling metering, position roller, and transfer roller movement, an heretofore unrealized reliability and flexibility is attained.

The invention additionally provides for indexing of articles while the turret is moving, enabling higher speed operation. Clamping and inflation assemblies rotate with the article, thus further increasing speed.

BRIEF DESCRIPTION OF THE DRAWINGS

Other aspects of the invention will become apparent after considering several illustrative embodiments taken in conjunction with the drawings in which:

FIG. 12 is a timing diagram of a sequence of events in accordance with the invention.

DETAILED DESCRIPTION OF THE INVENTION

Outline

- Overview
  - Elements
    - Web Module
      - Registration Assembly
      - Transfer Assembly
    - Turret Module
      - Drive Assembly
      - Cup Assembly
      - Inflation Assembly
    - Control Module
      - Power Supply Assembly
      - Amplifier Assembly
      - Servo Assembly
      - Processor Assembly
  - Element Operation
    - Storage Control Circuit
    - Position Roller Control Circuit
    - Metering Control Circuit
    - Transfer Control Circuit Take-up and Supply Control Circuits
System Operation

Overview

The following description is made with reference to the application of heat transfer type labels, such as shown and described in U.S. Pat. No. 4,313,944 to Kingston. However, it should be understood that the inventive concepts disclosed herein may be used whenever it is desired to transfer a label, disposed on a web, to an article. A preferred embodiment of the invention comprises three interconnected module types: one or two web modules for movement of the web; a single turret module including a base for movement of the articles, and a control module for integrating the actions of the web and turret modules. The control module contains a processor, which receives instructions from the remaining modules as well as the operator. Once operating parameters have been established, they may be stored in a plug in cartridge for future use. Additionally, several cartridges may be used, wherein switching from the decoration of one article type to another is facilitated. The web module provides for precise movement of the web, bi-directionally over the transfer roller as well as towards and away from the article at the decorating site. The turret module enables rapid indexing and inflation by performing these functions during rotation.

ELEMENTS

Web Module

To provide for registration and application of labels, one or two web modules 100 are provided. A module includes a registration assembly 10R, comprising a series of rollers which support the web, and a position roller and metering rollers, which precisely control web movement. Additionally, a transfer assembly 10T is provided, for transferring labels to the articles to be decorated.

Registration Assembly

Figure 1:
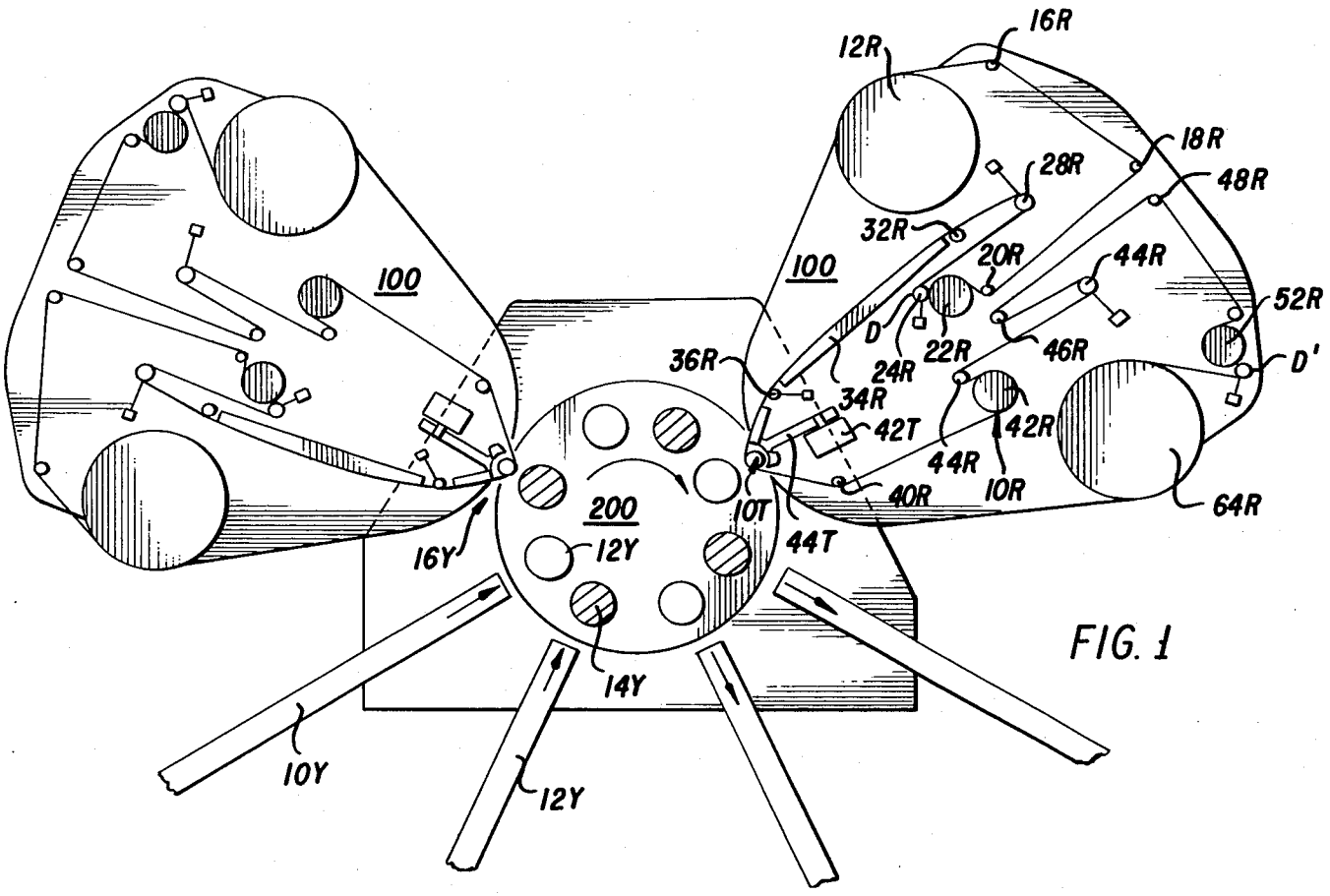
FIG. 1 is a plan view of a turret, base, two web modules, and conveyors, in accordance with the invention.
Figure 2:
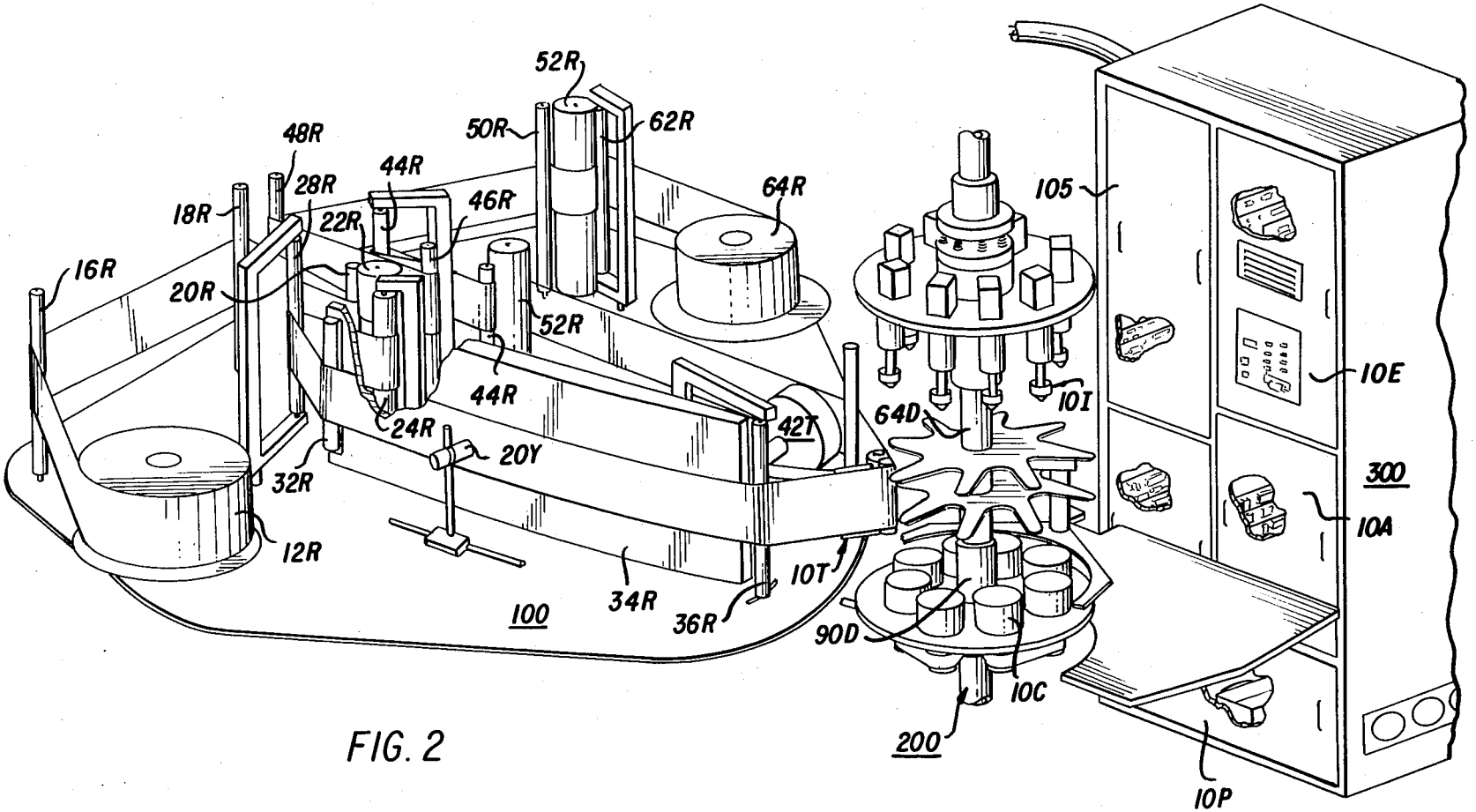
FIG. 2 is a perspective view of a decorator in accordance with the invention.
Figure 3:
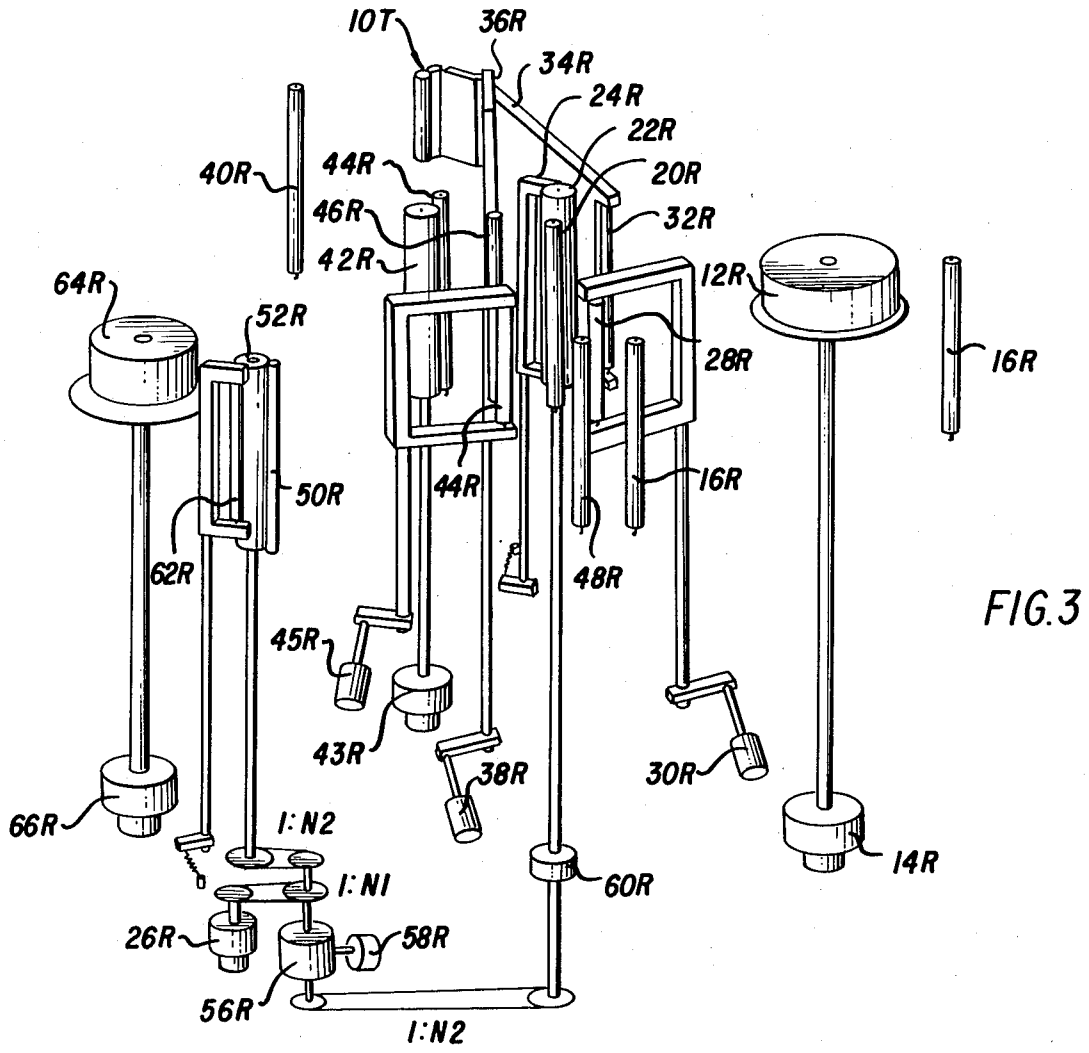
FIG. 3 is a schematic view of web registration elements.

Referring to FIGS. 1, 2 and 3, registration assembly 10R provides for controlled bi-directional movement of the lable-bearing web past a label transfer, or decorating, site. In a preferred embodiment of the invention, the web is fed from a supply reel 12R, controlled by motor 14R, to positioning idlers 16R, 18R, and 20R. The web passes over a metering roller 22R, and is maintained against same by a biased roller 24R. Metering roller 22R is driven by motor 26R, as is further described below. Dancer roller 28R, connected to air cylinder 30R, cooperates with metering roller 22R to provide for rapid web supply during decoration. Idler 32R positions the web for travel over a preheater 34R. Roller 36R, controlled by an air cylinder 38R, provides for lifting of the web off the preheater during an interrupted decoration. Transfer assembly 10T, discussed further below, is positioned at the decorating site. Idler 40R positions the web for contact with position roller 42R. Idler 44R cooperates with position roller 42R for increased position roller/web contact area. Motor 43R drives position roller 42R. A take-up dancer roller 44R, operated by air-cylinder 45R, cooperates with metering roller 42R for rapid web takeup during decoration. Idlers 46R, 48R and 50R position the web for contact with a second metering roller 52R. Biased roller 54R maintains the web against roll 52R. Motor 26R drives roller 52R via a pulley ratio. A variable ratio differential assembly 56R is coupled to motor 26R, and is adjusted by motor 58R. The input of differential 56R is coupled to motor 26R output. Differential 56R output is coupled to roller 22R via a pulley ration and an electrically actuated cluch 60R. Roller 62R is spring biased against roller 52R. Take-up reel 62R, operated by motor 64R, collects the web.

Transfer Assembly

With reference to FIGS. 1, 2, 3 and 4, transfer assembly 10T comprises a transfer carriage 20T, and a drive assembly 40T. Transfer carriage 20T includes a platen 22T, transfer roller 24T, and transfer roller heater 26T. Drive assembly 40T comprises a motor 42T connected to a rack 44T. Transfer carriage 20T is coupled to rack 44T, the latter supported by bearings 45T.

In operation, described further below, the transfer carriage may be driven at great acceleration rates. As a result, a high force would be required to drive the carriage if same were of even modes weight. Similarly, conventional rotary to linear motion converters, such as gears and cams, add weight and resistance to the carriage and drive elements. Moreover, conventional motion transducers would wear out in a relatively brief time period due to the millions of operational cycles to which the carriage and drive are subjected. Accordingly, the invention provides a motion converter which includes two or more flexible bands 46T, 48T which are fastened at one end to the motor driveshaft, and at the other end to the carriage. The bands are preferably fastened to remain in secure, abutting contact with the shaft over a portion of their length as the carriage is moved to its extreme positions. Thus, the bands follow the motor movement with great precision. Additionally, the carriage is designed to be as lightweight as possible, to minimize the size and power consumption of the motor, and to allow rapid positioning motions.

TURRET MODULE

As shown in FIGS. 1, 2, 5, 6, 7 and 8, a turret module 200 is provided for positioning the articles at the conveying and decorating stations. Including is a drive assembly 10D which provides continuous and intermittent rotational motion via a two part shaft and sleeve. A cup assembly 10C spuports, indexes and rotates the articles to be decorated. An inflation assembly 10I introduces pressurized air to the articles for stability during decoration, and provides for clamping of the articles.

Drive Assembly

Figure 5:
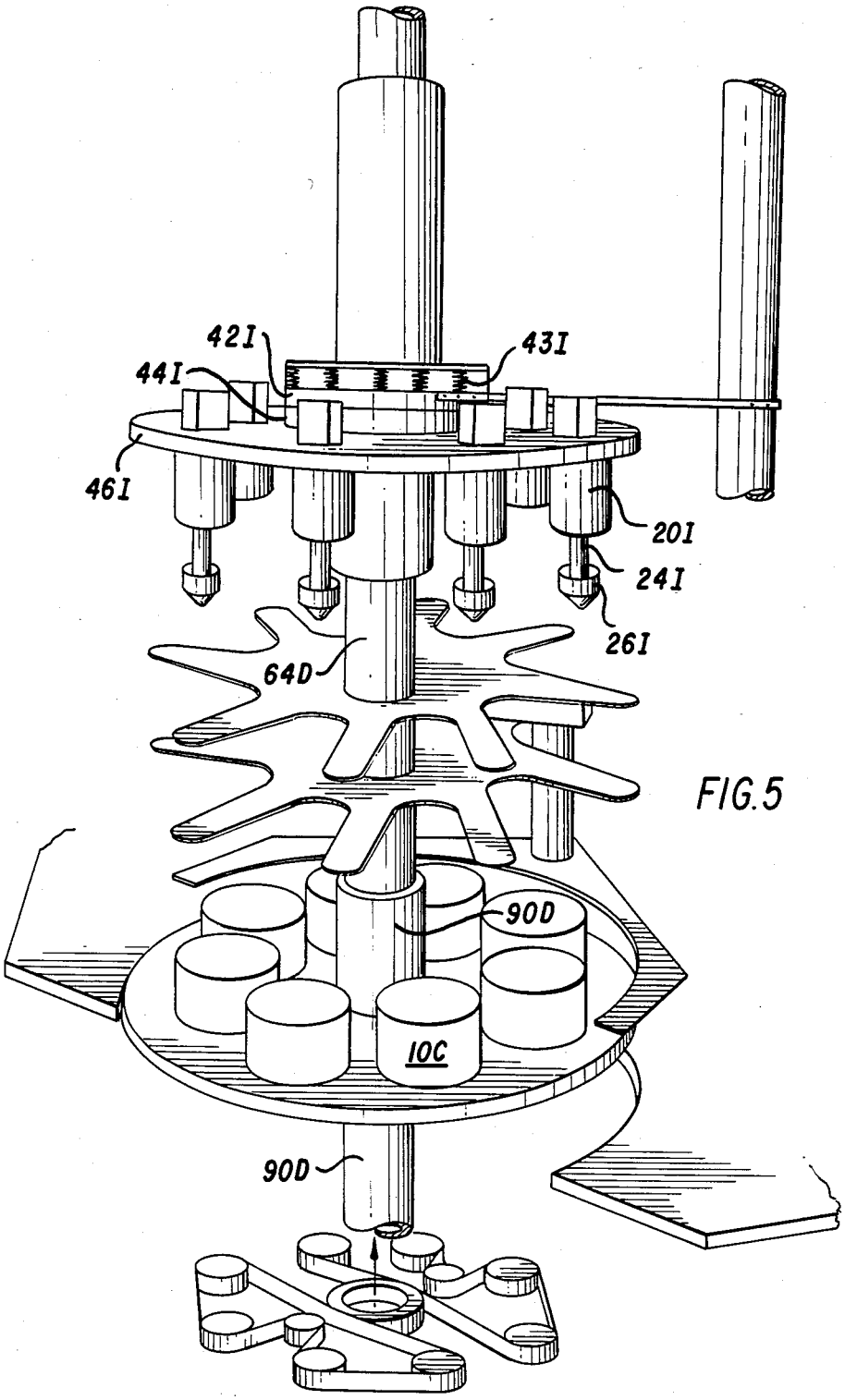
FIG. 5 is a perspective view of a turret module.
Figure 6:
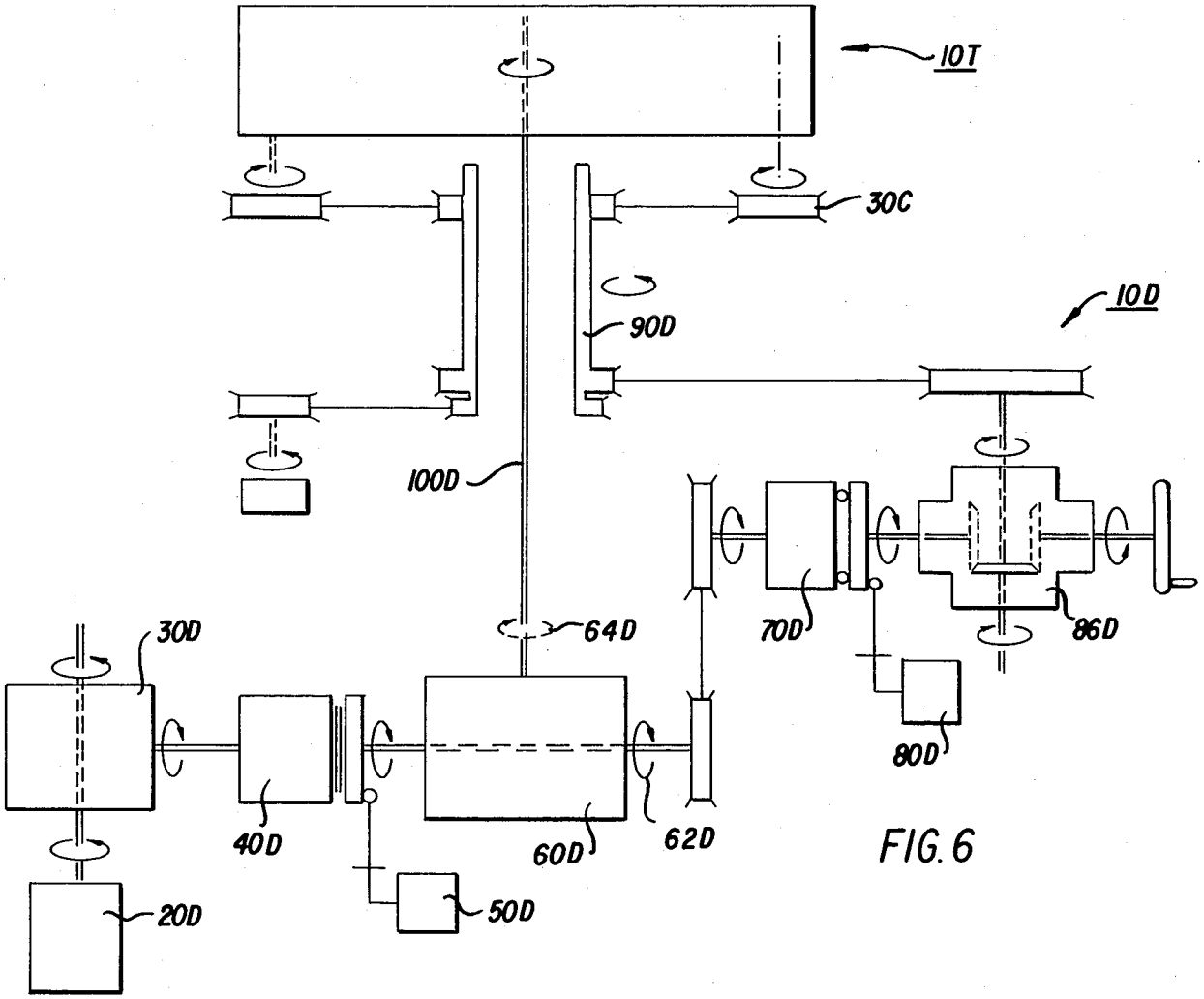
FIG. 6 is a schematic view of the turret drive assembly.

Considering FIGS. 5 and 6, drive assembly 10D includes an electric motor 20D coupled to a speed reducer 30D. For enhanced safety, an overload mechanism 40D is provided, such as a friction clutch, preferably positioned downline from speed reducer 30D. A limit switch 50D may further be provided cooperative with overload mechanism 40D. An index drive 60D, such as the roller cam type, is coupled to overload 40D output, to provide separate continuous 62D and intermittent 64D outputs. Continuous output 62D may additionally be provided with an overload mechanism 70D, such as a single position mechanical air clutch, cooperative with a continuous limit switch 80D. Overload 70D output is next transmitted through an angle drive 86D to a turret sleeve 90D, rotatably mounted about turret shaft 100D. The intermittent output is coupled to turret shaft 100D.

Cup Assembly

As can be seen in FIGS. 2, 5, 6 and 8, cup assembly 10C includes an indexing member 20C which drives the article during decoration. A support member 50C delays or stops article rotation to enable indexing member 20C to engage the article 10a. A base plate 80C provides for vertical movement of the article, to facilitate entry to and exit from the turret.

Indexing member 20C comprises two posts 22C, 24C, which extend upwardly from base 26C. An indexing pin 34C is disposed atop each post 22C, 24C, disposed within bores 35C, biased upward by springs 37C. Shaft 28C is rotatably mounted within support member 50C via bearings 36C. A shaft 28C couples base 26C to turret sleeve 90D via a pulley 30C and belt 32C.

Support member 50C comprises a receptacle 52C which surrounds indexing member 20C and is shaped at an upper profile 54C to engage the lower rim of the article. A friction member 56C, encircles support member 50C. Bearings 58C rotatably maintain support member 50C on a cup plate 60C mounted to turret shaft 100D.

Base plate 80C includes a surface 82C, upon which the article is maintained in an upright position. Posts 22C, 24C slideably extend through apertures 84C,86C in surface 82C. A stem 88C extends axially down through shaft 28C, slideably retained by bearings 90C,92C. Biasing means 94C,96C urge surface 82C upwards

Inflation Assembly

Figure 7:
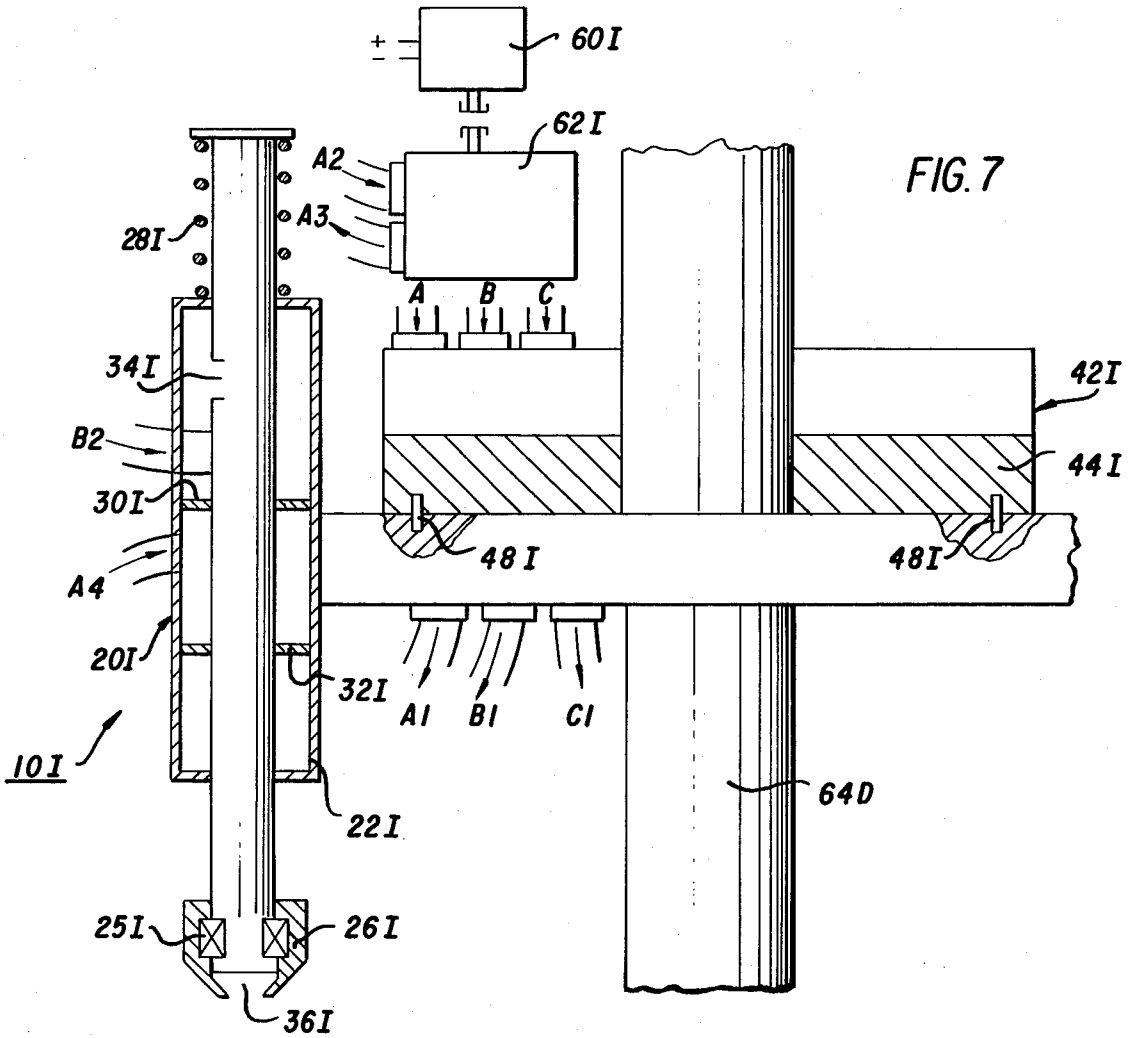
FIG. 7 is a cross-sectional view of the inflation assembly, in accordance with a preferred embodiment of the invention.
Figure 8:
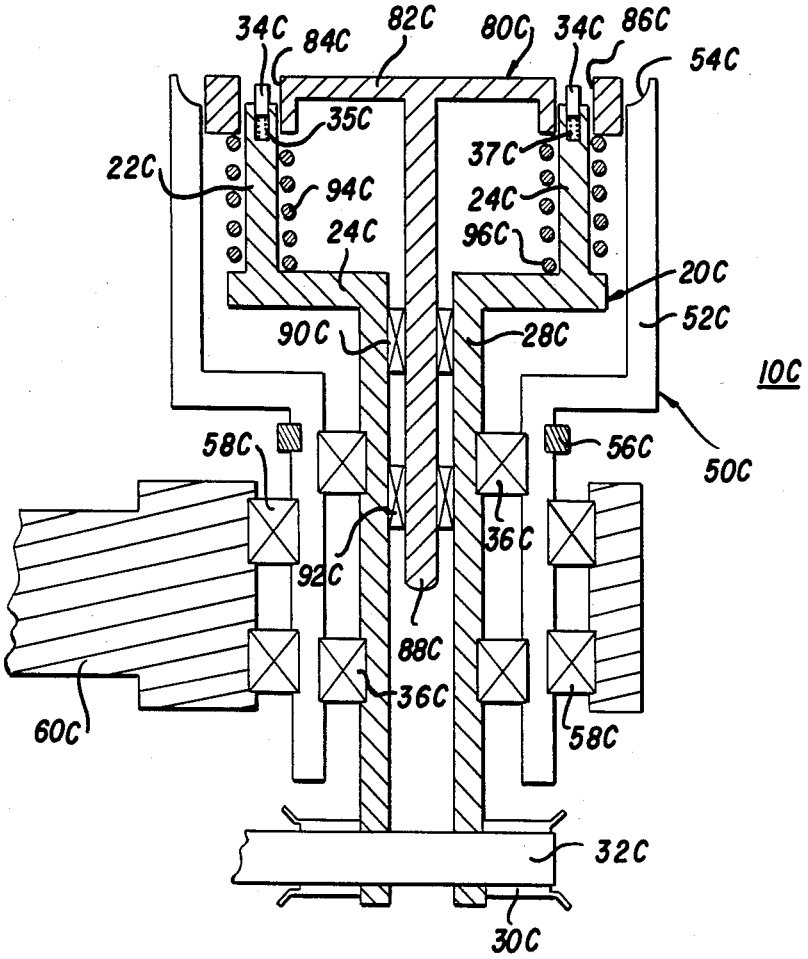
FIG. 8 is a cross-sectional view of a cup assembly of the invention.
Figure 9B:
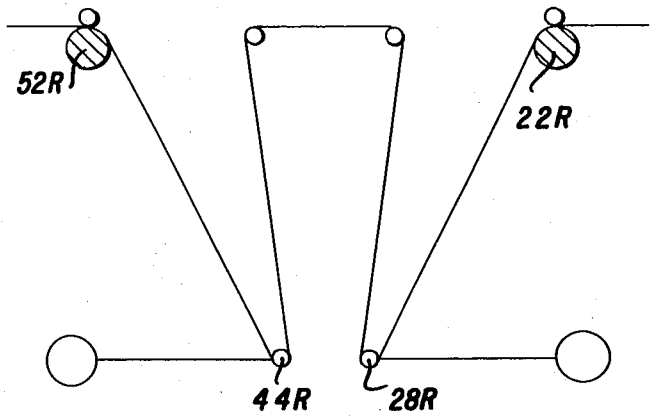
FIG. 9 is a diagramatic view of dancer arm position.
Figure 9D:
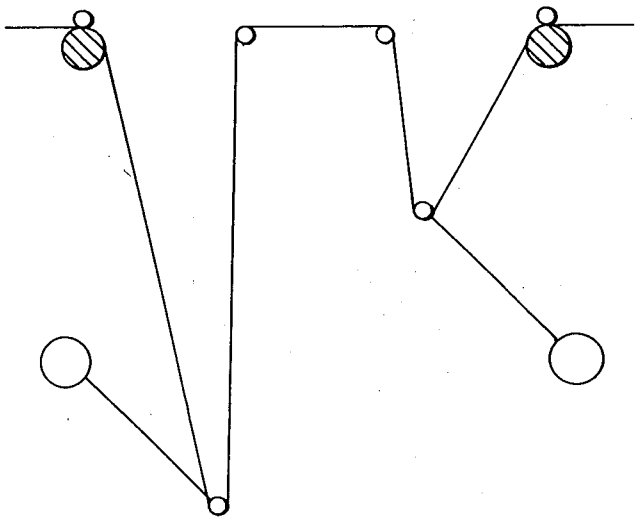
Figure 9A:
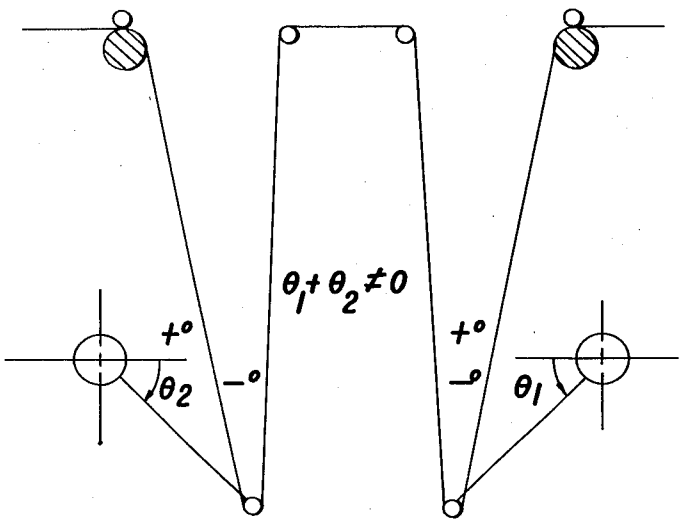
Figure 9C:
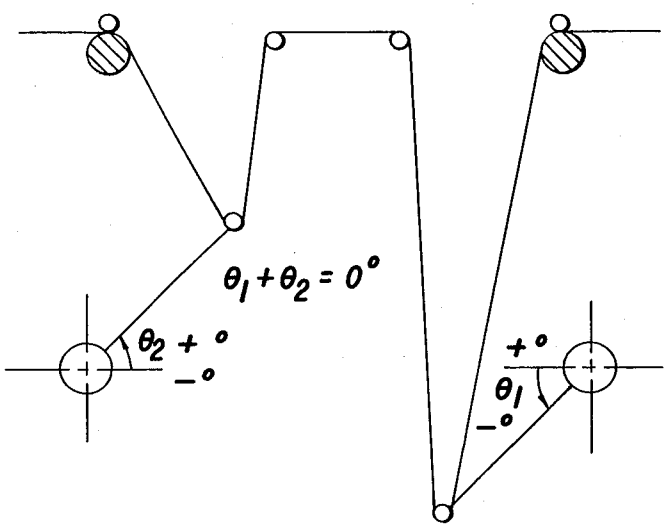

With reference to FIGS. 2, 5 and 7, inflation assembly 10I is disposed about turret shaft 100D, with one inflation nozzle assembly 20I positioned directly above each cup. Each nozzle assembly 20I comprises an air cylinder 22I which houses a hollow ported shaft 24I. An article engaging member 26I is rotatably mounted to the end of shaft 24I supported by bearing 25I. Biasing means, such as spring 28I urges shaft 24I in an upwards direction. Cylinder 22I is divided by a seal 30I, whereby when pressurized gas, such as air, is introduced into cylinder port A4, piston 32I is urged downwardly. Shaft 24I is provided with port 34I, wherein when shaft 24I is moved downwards, pressurized fluid may be introduced via inflation port B2. Gas thus introduced exits via outlet 36I.

Control of gas to ports B2 and A4 is achieved via a rotary plate valve 40I, and a solenoid actuated valve assembly 60I. Valve A receives gas for driving shaft 24I downwards, valve B receives gas for inflation, and valve C receivs gas for inflation for a complementary web module.

Timing of inflation gas introduction is achieved by rotary plate valve 40I, which comprises an upper plate 42I, a central ported plate 44I, and a lower plate 46I. Plate 46I is coupled to turret shaft 100D, and rotates in unison with ported plate 44I through connection by pins 48I. Plate 42I is prevented from rotating by a bracket 50I, and is spring biased against plate 44I by springs 43I. Timing of cylinder gas introduction is achieved via plate valve 40I and solenoid valve assembly 60I. Gas from port A1 is introduced to valve 60I at port A2, disposed within valve 62I. At the appropriate time, discussed below, solenoid 64I actuates valve 62I, whereby gas exits via port A3, to enter at port A4 in cylinder 20I.

CONTROL MODULE

With reference to FIG. 2, a control module 300 is provided cooperative with the turret, web modules, and conveying members to control movement of elements therein. Control module 300 comprises a power supply assembly 10P, servo amplifier assembly 10S, servo control assembly 10A, and a processor assembly 10E. Power is distributed from power supply assembly 10P to control elements 10S,A and E. Signals from functional elements are received by servo control assembly 10a, which is interactively coupled to processor assembly 10E. Control amplifier assembly 10A sends servo and functional commands, such as enable signals, to the servo assembly 10A. Each functional element, however, may be controlled in a unique manner, as discussed in greater detail below.

Power Supply Assembly

Alternating current (A.C.) is provided with overload protection and line conditioning and is transformed to a variety of A.C. and direct current (D.C.) voltages by a power supply assembly 10P. Relays cooperative with the processor enable high voltage disconnect by a low voltage signal. Line conditioners protect electronic circuitry from voltage fluctuations. Additionally, analog to digital converters are provided for enabling processor monitoring of certain decorator signals

Servo Amplifier Assembly

A servo amplifier assembly 10S provides a prescribed voltage level to the web 100 and turret 200 motors. The amplifiers receive a low level control signal from servo control assembly 10A. The amplifiers included in 10A convert these servo control and processor command signals to the required motor voltages and currents to affect the commanded motions and conditions. For the turret drive motor, an amplifier responds directly to a control signal from the processor. For all other motors, the processor signal is first conditioned by the servo assembly 10S.

Servo Control Assembly

The servo control assembly 10A comprises a plurality of servoelectronic subunits, each of which is operative to positively control its respective servomotor through feedback interaction. Upon a signal from processor assembly 10E, a servo subunit generates a low voltage signal to the amplifier assembly 10S, which in turn causes operation of the motor. A shaft encoder cooperative with the motor returns a signal to the servo representative of shaft position. Alternatively, the back-EMF of the motor is used for determining shaft rotational velocity. The return signal is compared with instructions from processor assembly 10E, whereupon the servo adjusts its signal to amplifier assembly 10S in order to adjust motor speed, position, or torque accordingly. The comparative loop is repeated at high speed to render precise control of motor operation.

Processor Assembly

In a preferred embodiment, the microprocessor is of the 8086 type. Typically, 32–64 K memory is required for operation, although memory requirements are a function of software sophistication. Software storage is provided by eproms or proms. Operational memory is provided by dynamic rams. An interrupt controller is provided to funnel interrupt requires to the processor and to provide arbitration between simultaneous requests. Devices for timing, counting, and frequency generation interface with the microprocessor. For I/O communication, a series of parallel and serial devices are provided. Output drivers and input buffers condition the I/O signals. Generally, communication to a visual display, keyboard, hand controller, and host computer is performed by the serial devices. Communication to sensors and controller boards is performed by the parallel devices.

In order for the processor to communicate with control circuitry, digital to analog (D/A) converters are provided. Similarly, analog to digital (A/D) converters enable response back to the processor. The complex communication between the processor and the various D/A, A/D and I/O elements are coordinated by a bus structure.

To reduce noise interference, and to maximize adjustability, information is sent to some control circuitry, particularly the position and metering rolls, by frequency modulation. Thus, frequency generating and analyzing circuitry is additionally provided.

ELEMENT OPERATION

Storage Control Circuit

Figure 10:
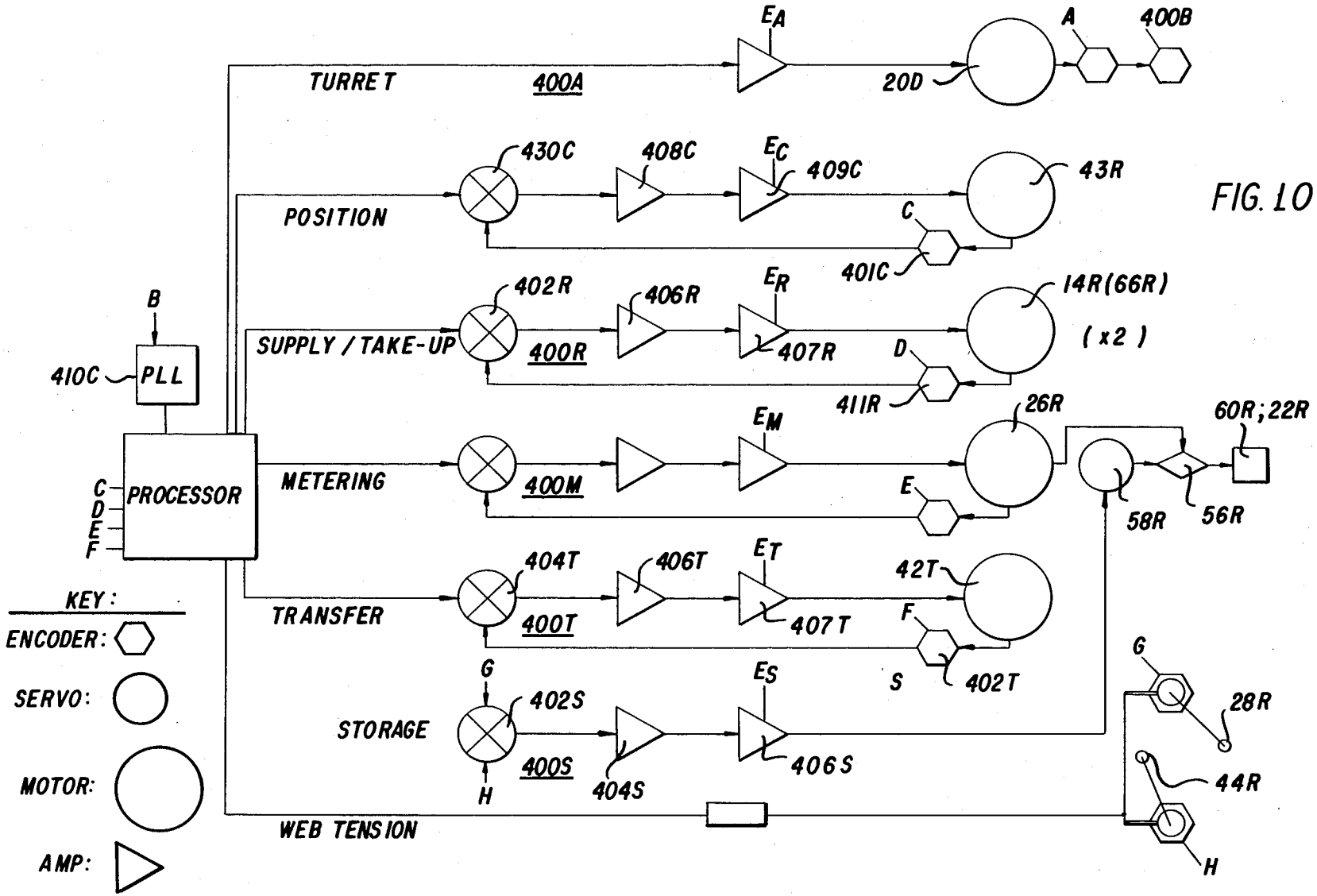
FIG. 10 is a schematic view of control circuits in accordance with the invention.
Figure 11:
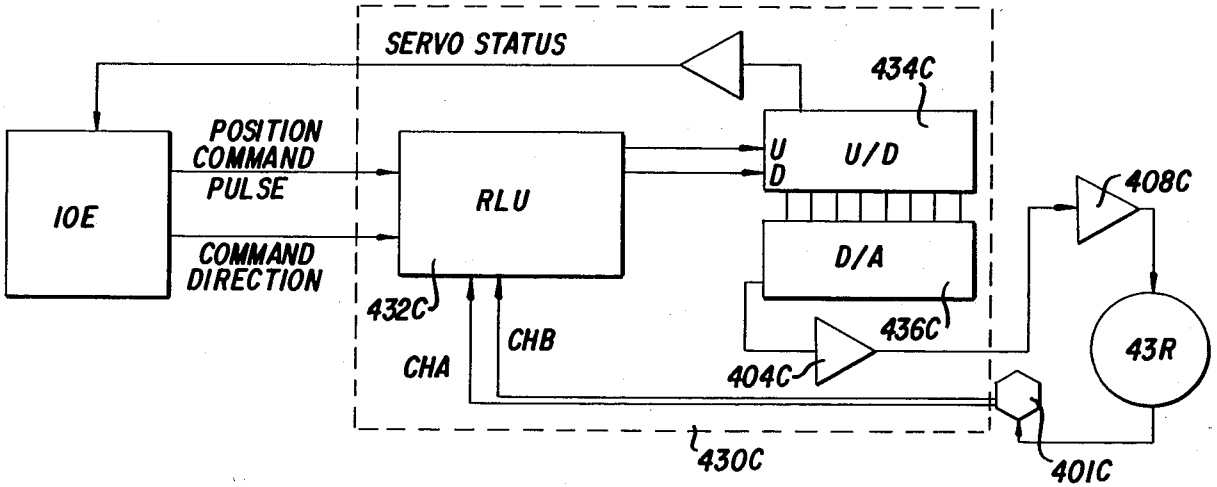
FIG. 11 is a schematic view of portion of the position roller control circuit.

With reference now to FIGS. 9, 10, and 11, a storage control circuit 400S is provided for introducing and maintaining a prescribed amount of web within the decorating loop. The decorating loop is shown in FIG. 1, between D, 10T and D'. After threading the web, dancer arms 28R, 44R reside at a random angles, typically with both arms positioned as in FIG. 9(*a*). At the beginning of the decorating cycle, it is desired to have the dancer arms at an optimum angle for rapid forward and reverse movement of the web past the transfer roller such as is shown in FIG. 9(*c*). Metering rollers 22R, 52R operate to feed in or draw out web from the decorating loop. In a preferred embodiment, metering roller 52R is held motionless, while the position roller is disenabled, allowing same to freely rotate. Metering roller 22R is driven by differential adjusting motor 58R. When the length of web in the D-10T-D' region (decorating loop) has attained its required value, position roller 42R is driven by motor 43R until dancer 44R attains an optimum position. The optimum position is where the sum of the dancer arm angles is 0°, as can be seen in FIG. 9. In FIG. 9 (*a*), the dancer arm angles incorrect for decoration. In FIG. 9 (*c*), the dancer arms are correctly positioned. The sum of the angles remains 0° throughout the decorating cycle.

Referring now to FIG. 10, storage control circuit 400S comprises a servo 402S, a servo amplifier 404S, a power amplifier 406S, and a differential adjustment motor 58R. Note that power amplifier 406S has input $E_S$. Inputs $E_{-A,C,R,M,T,S}$ are enable signals from the processor. The servo receives input from two dancer arm angle transducers, one cooperative with each dancer arm. The servo receives only an enabling signal from the processor, for its only function is to maintain a constant angular sum of dancer arm 28R, 48R positions, wherein the angle transducers provide all the necessary information. Adjustment is carried out by driving adjustment motor 58R, which is coupled to differential 56R, the latter being disposed in line between metering roller 52R and metering roller 22R. During initialization, position roller 42R remains free to rotate, while adjustment motor 58R drives the differential causing a net amount of web to be fed in or removed from the decorating loop. During decoration, small adjustments are made to maintain the dancer arm relationship.

Position Roller Control Circuit

With reference to FIGS. 10 and 11, position roller control circuit 400C provides for accurate bidirectional web movement within the D-10T-D' region. Signals for position roller movement are sent from the processor during web positioning, and from a phase lock loop (PLL) circuit during decoration. Position roller control circuit 400C comprises digital servo 430C, servo amplifier 408C, power amplifier 409C, drive motor 43R, and incremental encoder 401C.

During web positioning, the web is reversed for positioning the next label for decoration. At this time, processor 10E issues a pulse stream to digital servo 430C. Servo amp 404C drives the error signal from servo 430C to power amplifier 408C, thus causing rotation of position roller motor 43R. Encoder 401C returns the actual movement and encoded direction of the position roller to servo 430C, thus completing the error loop.

During decoration, it becomes necessary to precisely coordinate label movement with article rotation. Article movement is quite complex, despite whether or not a simple rotational command is given to the turret drive. This is due to vibrations and other disturbances imposed by various structural and environmental elements. Encoder 400B follows cup movement, and emits a signal to processor 10E. A corresponding signal is sent to PLL 402C, which ultimately commands servo 400C during decoration.

A phase locked loop circuit 410C is provided for generating an output pulse stream to processor 10E which proportionally corresponds to article surface positions. PLL 412C receivs a signal from turret encoder 400B, which corresponds to the rotational movement of the article. Additionally data signals from processor 10E are provided which are derived from the rotational position and radius of the article, at the decorating site, and the radius of the positioning roller. An output pulse is generated by PLL 410C which is sent to the processor 10E where it is selected during the decoration phase as the command signal for position roller servo 430C.

Position roller servo 430C is provided for precisely controlling position roller movement, based on an adjusted signal from 410C, or processor 10E. The major functional components of servo 430C include a random logic unit (RLU) circuit 432C, an up/down (U/D) counter 434C and a D/A converter 436C, and a servo amplifier circuit 404C.

Processor assembly 10E selects either the signal from PLL 410C, during decoration, or a software generated signal, during web positioning. The selected signal is sent to servo 430C, along with a direction and enabling command. In addition, a status line is returned from 430C to 10E to indicate whether or not the position roller servo is able to position to the position roller within acceptable limits.

RLU 432C logically manipulates the commanded direction, the number of received command pulses (from an initial zero value), the number of received encoder pulses, and the actual direction information (encoded in the relationship between channels A and B), and issues either a countup or count-down pulse to U/D counter 434C. The value in the counter is representative of the instantaneous position error between commanded and actual positions. The digital output of counter 434C is passed to a D/A converter, thus generating an analog servo error voltage. This voltage is amplified by servo amp 404C and power amp 408C, wherein motor 43R is driven in the proper direction and speed, such as to decrease the servo error.

Metering Control Circuit

Metering control circuit 400M operates metering rollers 22R, 52R to advance the web into the decorating loop at a prescribed rate.

Metering control circuit 400M is identical to position roller control circuit 400C, however PLL control may optionally be eliminated. Both metering rollers 22R, 52R may be controlled by operation of motor 26R, since metering roller 42R is proportionately coupled (via pulley ration) to motor 26R. Metering roller 22R is identically coupled via differential 56R.

Transfer Control Circuit

Figure 4:
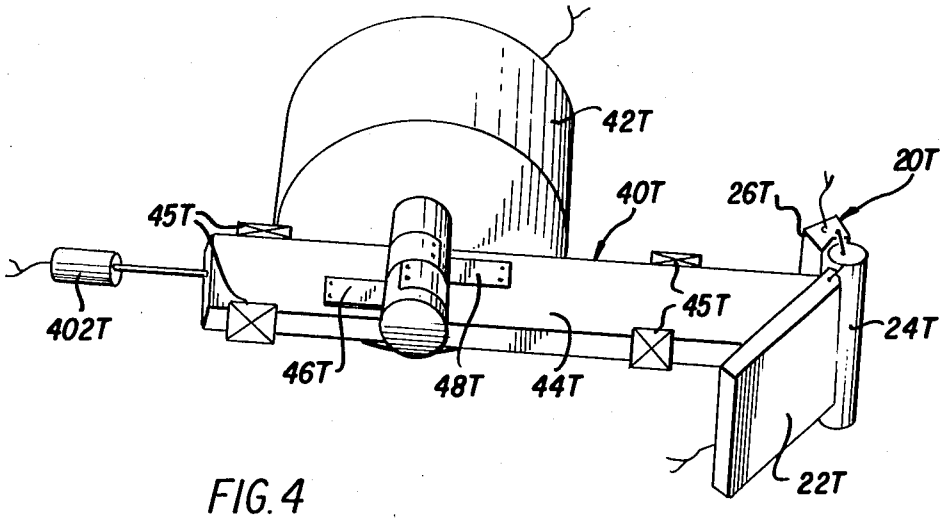
FIG. 4 is a perspective view of a transfer assembly in accordance with the invention.

The transfer drive carriage is coupled to motor 42T via flexible bands as shown in FIG. 4. A position transducer 402T generates a signal representative of the relative position of the carriage to the article. This signal is compared in servo 400T against the position command signal emitted by processor 10E, wherein the result is used to drive motor 42T via servo and power amplifiers 406T, 407T to reduce the difference between commanded and actual carriage position. Commanded position may be derived from preprogrammed data, as provided by a human operator, or from a sensor which monitors the article surface at the decorating site.

Take-up and Supply Control Circuits

For unwinding and rewinding of the web from reels, take-up and supply control circuits are provided, each circuit being identical. For simplicity, the unwind circuit will be described. A circuit is shown in FIG. 10 as 400R, and comprises servo 402R, servo amplifier 406R, and power amplifier 407R. Servo 402R receives a signal from processor 10E which is used to control the amount of torque the motor applies to reel 12R. Servo 402R periodically reads the back EMF of motor 14R in order to generate a signal which is sent to the processor 10E. this signal is representative of the reel rotational velocity.

Motor 14R is commanded to exert a certain torque. The magnitude of this torque is calculated to result in a constant web tension. However, since web tension is the quotient of torque divided by radius, and since radius is constantly changing, the radius must be continuously determined, a new value of torque calculated, and the updated value of motor 43R torque commanded via servo 400R. In order for this process to be executed, reel radius must be determined. Reel radius is the quotient of linear web velocity divided by reel rotational velocity. Linear web velocity is determined from knowledge of label length and unit article rate (articles per unit time). Reel rotational rate is determinable from the aforementioned motor 14R back EMF, motor 14R being a permanent magnet D.C. motor. Encoder 411R thus may be a grounded resistor. As a consequence of continuously monitoring reel rotational velocity, two additional advantages of the invention are obtained. First, a sudden reversal in the polarity of the back EMF signal generated by 43R can be interpreted as an early warning of a web break. Second, the constant determination of reel radius can be used to signal the time when a new reel of labels should be spliced to the existing web.

Motor 14R is operated to apply force in the opposite direction of web travel. As the diameter of reel 12R changes, the motor control signal must be varied to maintain a constant torque. Since torque is a factor of force and radius, processor assembly 10E must be able to determine the roll radius, and command the appropriate force to be applied and maintained by servo 402R. Reel 12R radius can be arrived at by taking the quotient of linear web speed and radian rotational web speed. Linear web sped is determined by taking the product of two knowns, label length and article/minute speed of operation. Radian rotational web speed is the quotient of EMF divided by a constant.

Once torque calculations have been made, processor 10E has the information needed to issue an early splice warning may be issued for an exhausted supply reel. Additionally, web breakage can be signalled when the polarity of the EMF signal becomes reversed.

SYSTEM OPERATION

THe invention provides for the decoration of articles, such as plastic bottles. The above described elements cooperate in a manner which is timed and coordinated for the particular article to be decorated. A typical timing diagram is shown in FIG. 13. However it should be understood that specific timing and speeds are varied for different article shapes and types. Moreover, the invention provides for rapid and simple variation of many operating parameters.

With reference to FIG. 13, 0′ indicates article loading, while 270′ indicates article unloading, from turret module 200. Before decorating begins, the web is threaded as shown in FIG. 1. Next, the processor analyzes signals from sensors to ascertain whether all circuits are operational. Typically, web storage is incorrect after threading. Storage control circuit 19S is activated to relatively position dancer arms 28R, 44R. The position roller control circuit 400C is invoked to absolutely position dancer arm 44R. Additionally, metering control circuit 10M and position roller control circuit 400C are appropriately commanded to position the web to a previously defined registration mark on the label in preparation for the beginning of decoration.

At 0′, the articles are loaded from input conveyors 10*y*, 12*y*. Gating means (not shown) are provided for controlled article entry. With two web modules in use, an article is loaded at each conveyor, however the progress of shaded article 14*y* entering at conveyor 12*y* is as follows. Plate valve 40I operates to permit air passage to valve assembly 60I. Processor 10E maintains valve 60I closed until the article is seated in cup 52C. Similarly, plate valve 40I operates to permit passage of air to port B2. However, air cannot escape nozzle 36I until shaft 24I descends, opening port 34I. Thus, when the article is seated, valve 60I is opened and the article is clamped and inflated, as the article is clamped, base plate 80C lowers thus causing contact between the article and cup rim 54C.

A friction arm at the loading station presses against ring 56C, thus preventing forwards cup rotation. Pins 34C rotate continuously throughout decoration, speeding up briefly as the rotating outer sleeve 90D is itself rotated by inner shaft 100D. As a result, pins 34C rotate relative to the article until reaching indexing grooves on the article undersurface. Springs 37C urge pins upwards into the grooves, whereby the article and cup begin to rotate. Note that in FIG. 13F, a spike appears between 0' and 90'. This is a result of the cup rotating backwards relative to the indexing pins.

At the end of 90' rotation, article 14Z is at decorating site 16. position roller 42R is advancing the web in a forwards direction, aligning the label for decoration. Processor 10E coordinates article orientation and the transfer roller 24T, so that decoration begins at the correct location on the article surface. After transfer roller 24T contacts the article, position roller 42R position is precisely regulated for desired stretch and/or shrink of the label. Metering rollers 22R, 52R rotate to maintain a constant rate of web passage through the decorating loop. As position roller 42R advances the web, dancer arm 28R moves in the direction of the decorating site. Concomitantly, dancer arm 44R moves in the direction away from the decorating site. The angular relationship between dancer arms 28R, 44R is normally maintained without substantial correction by storage control circuit 400S, during decoration.

After the label has been applied, transfer roller 24T is moved away from the article, and position roller 42R speed is reduced. During rotation of turret module 200 to the 180' position, position roller 42R reverses direction, providing a leader for the next label. When the required label leader is attained, position roller 42R rotates forward during which time the web is registered utilizing sensor 20*y*. At 180', article 14*y* rotates awaiting positioning at the exit conveyor.

As the turret rotates to 270' plate valve 40I permits exhaust of air from cylinder 22I, while closing off passage of pressurized air thereto. At this juncture the article is unclamped as piston 24I moves vertically, urged by spring 28I. With the clamping force removed, springs 94C, 96C urge base 80C upwardly, enabling any of the known removal means to slide the article off of cup 10C. In the last portion of the turret cycle, the cup occupied by article 14*y* is moved to its original loading position. During turret rotation, valve 60I begins to admit air into port A4, as the next article is loaded.

In the decoration of the article 124, events are similar to those described for article. However decoration occurs at 180' of rotation, as opposed to at 90' for article 14*y*.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for applying labels, disposed on a web, to articles, comprising:
   - means for moving the articles to an application site;
   - means for sensing movement of the articles;
   - means for feeding the web to the application site; and
   - means responsive to the sensing means for continuously coordinating the movement of the web relative to the movement of each article;
   - wherein said means for feeding the web to the application site comprises a position roller operative to position labels at said application site, a plurality of metering rollers operative to supply labels to said position roller, a plurality of sensors operative to monitor position roller movement and metering roll movement, and a processor connected to said sensors operative to issue commands based on said sensors.

2. Apparatus for applying labels, disposed on a web, to articles, comprising:
   - means for moving the articles to an application site;
   - means for sensing movement of the articles;
   - means for feeding the web to the application site; and
   - means responsive the sensing means for continously coordinating the movement of the web relative to the movement of each article;
   - wherein said means for feeding the web comprises two metering rollers defining a decorating loop there between, two dancer rollers disposed within the decorating loop, a position roller disposed between said dancer rollers in the decorating loop, means for loading said dancer rollers to apply tension to said web, means for driving said metering rollers, and means for driving said position roller.

3. Apparatus of claim 2, wherein said means for driving said metering rollers comprises:
   - a motor having an output coupled to one of said metering rollers;
   - a differential having an input coupled to said motor output, an output coupled to the other of said metering rollers, and an adjusting input; and
   - an adjusting motor coupled to said differential adjusting input; and
   - wherein said means for driving said position roller comprises:
   - a motor having an output coupled to said position roller; and
   - means for sensing movement of said position roller; and
   - wherein said means for continuously coordinating comprises:
   - means for sensing movement of said metering rollers and said position roller;
   - a servoelectronic circuit operative to control said motor coupled to one of said metering rollers;
   - a servoelectronic circuit operative to control said motor coupled to said position roller; and
   - a microcomputer processor circuit operative to command said servoelectronic circuits based on input from said means for sensing.

4. Apparatus of claim 3, wherein said servoelectronic circuit comprises:
   - a random logic unit circuit connected to said means for sensing and said microcomputer processor circuit;
   - an up/down counter circuit connected to said random logic unit circuit; and
   - a digital to analog converter circuit connected to said up/down counter circuit.

5. Apparatus of claim 4, wherein said microcomputer processor circuit comprises:
   - a phase locked loop circuit having a first input connected to said means for sensing movement of the articles, a second input connected to said microcomputer processor circuit, and an output connected to said servoelectronic circuit operative to control said motor coupled to said position roller.

6. A method of tentionally supplying and reeling web, comprising the steps of:
   - (1) applying torque to web supply and take-up reels using a survelectronically controlled motor;
   - (2) determining the amount of torque to be applied over time, dependent on wheel radius established by a processor providing the quotient of linear web speed divided by radian rotational web speed, where linear web speed is determined as the product of label length and articles advanced per minute, and radian rotational web speed is determined as the "back emf" of the motor divided by a constant;

(3) signalling a break in the web, by way of said processor, as determined by a reversal in polarity of the back emf of said motor; and (4) indicating by way of said processor that it is time to change the web supply reel on the basis of determined roll radius.

7. Method of applying labels to articles, comprising the steps of:

passing the web through a first nip, over a moveable tensioning roller, a position roller, a second moveable tensioning roller, and through a second nip, the first and second nips connected by a variable rate differential;

maintaining one nip motionless while allowing the position roller to move freely;

rotating the second nip until a desired amount of web is between the nips as determined by sensing the position of the tensioning rollers;

rotating the position roller until the moveable tensioning rollers are at a desired orientation;

driving the variable rate differential to alter the relative rotational velocity of the nips.

8. Method of claim 7 further comprising the steps of:

monitoring movement of the articles with a sensor;

driving the position roller with a servo circuit responsive to a signal from a microprocessor based on the monitored article movement;

coordinating movement of the web to vary the speed of the web in relation to movement of the articles.

9. Apparatus for applying labels, disposed on a web, to articles, comprising:

means for moving the articles to an application site, including means for indexing the articles while the same are moved;

means for sensing movement of the articles;

means for feeding the web to the application site; and means responsive to the sensing means for continuously coordinating the movement of the web relative to the movement of each article;

the means for moving comprising:

a shaft with at least one post connected thereto in non-axial parallel alignment therewith and a pin disposed atop each post;

a supporting rim rotatably mounted in axial alignment about said shaft and means for urging the article into contact with said rim;

means for moving said rim and the urging means, and means for rotating said shaft as said rim is moved; and means for momentarily preventing rotational motion in the direction of shaft rotation of said rim.

10. Apparatus of claim 9 wherein said means for moving the rim and urging means comprises:

a base;

means disposed within said base for providing an intermittent motion output;

a drive shaft extending from said base connected to said intermittent output and said rim and urging means; and wherein said means for rotating comprises:

means disposed within said base for providing a continuous motion output; and a drive sleeve disposed about said drive shaft coupled to said continuous motion output and said shaft.

11. Apparatus of claim 10, wherein said urging means further comprises:

an air cylinder;

a ported shaft extending from said air cylinder;

means for introducing pressurized gas communicative with said ported shaft;

means for introducing pressurized gas communicative with said air cylinder; and an output nozzle disposed about the end of said ported shaft, in air passing communication with said source of pressurized gas communicative with said ported shaft.

12. Apparatus of claim 11, wherein said means for introducing pressurized gas comprises:

a rotary plate valve connected to said drive shaft;

a valve coupled to said rotary plate valve disposed in line between one source of pressurized air and said air cylinder; and means for actuating said valve.

13. Method of continuously web movement relative to article movement comprising the steps of:

(1) receiving in an electronic circuit a pulse stream from an encoder responsive to the angular position of the article;

(2) transforming the received pulse stream in the electronic circuit based on parameters provided by a processor; and (3) driving a positioning roller cooperative with the web via an amplifier conencted to the transformed signal, using a servoelectronic circuit.

14. Method of claim 13, wherein in step (2) said parameters provided by the processor are derived from the rotational position and radius of the article, at the decorating site, and the radius of the positioning roller.

15. Apparatus for applying labels, disposed on a web, to articles, comprising:

means for moving the articles to an application site;

means for sensing movement of the articles;

means for feeding the web to the application site; and means responsive to the sensing means for continuously coordinating movement of the web relative to the movement of each article;

said apparatus further comprising a transfer roller at the application site, an elongated member coupled at one end to said transfer roller, a motor having an output shaft perpendicularly disposed in proximity to said elongated member, at least two flexible bands each fastened at one end to said elongated member and fastened at the opposite end to said motor shaft, and means for driving said motor to continuously coordinate movement of the transfer roller relative to the surface of the article at the decorating site.

16. Apparatus of claim 15, further comprising:

means for sensing the position of the articles surface at the deocrating site.

* * * * *